US005127652A

United States Patent [19]

Unger

[11] Patent Number: 5,127,652

[45] Date of Patent: * Jul. 7, 1992

[54] TOY AND PUZZLE WITH REVERSIBLE BREAKABILITY

[76] Inventor: Vicki Unger, 10 Red Bark Ct., Lafayette, Calif. 94549

[ * ] Notice: The portion of the term of this patent subsequent to Dec. 12, 2006 has been disclaimed.

[21] Appl. No.: 611,234

[22] Filed: Nov. 9, 1990

[51] Int. Cl.[5] ..... A63F 9/12

[52] U.S. Cl. ..... 273/157 R; 273/58 R; 273/428; 273/456; 446/92; 446/419

[58] Field of Search ..... 273/153 R, 156, 157 R, 273/58 R, 58 A, 58 J, 127 A, 317, 456, DIG. 4, DIG. 5, DIG. 6, DIG. 8, DIG. 12; 446/4, 92, 419, 901

[56] References Cited

U.S. PATENT DOCUMENTS

| | | | |
|---|---|---|---|
| 2,989,782 | 6/1961 | Barkhuff | 273/58 J |
| 3,099,450 | 7/1963 | Randall | 273/58 A |
| 3,117,384 | 1/1964 | Billis | 273/58 R |
| 3,518,786 | 7/1970 | Holtvoigt | 273/58 A |
| 3,873,485 | 3/1975 | Fichera | 273/58 J |
| 4,886,273 | 12/1989 | Unger | 273/157 R |
| 4,944,363 | 7/1990 | Osher | 273/58 A |

*Primary Examiner*—Theatrice Brown
*Assistant Examiner*—William M. Pierce
*Attorney, Agent, or Firm*—Townsend and Townsend

[57] ABSTRACT

A combination breakable toy and puzzle. A ball comprises eight identical wedge-shaped elements, each having a resiliently deformable foam core and a smooth outer skin. Within the interiors of the individual elements, near the vertices thereof, magnets are mounted for interacting with magnets mounted on the interiors of other wedges, such that the ball can be magnetically assembled by matching opposite polarities of the magnets. The ball may be pried apart, or may be broken apart without structural damage by throwing it against a wall or the floor, and may then be reassembled. The ball may be used as a puzzle, challenging a child to assemble it in the proper fashion. Plus and minus signs may be provided on the faces of the wedge-shaped elements to assist in this task. Other configurations for the toy are cubes, pyramids and baby rattles.

26 Claims, 3 Drawing Sheets

TOY AND PUZZLE WITH REVERSIBLE BREAKABILITY

BACKGROUND OF THE INVENTION

The present invention is directed to a toy which is assembled by means of magnets mounted within individual pieces of the toy, which may be broken apart and reassembled without damage to the toy.

Certain toys allow for break-up and reassembly, such as those described in U.S. Pat. No(s). 2,996,833, 2,803,920, and 3,687,452. Some devices are held together by mechanical means such as hooks and springs, and some have portions which are mounted by magnetic means such as those described in U.S. Pat. No(s). 3,254,440, 3,655,201, 4,238,905 or German Offenlegungsschrift No. 2,346,555. However, earlier devices do not show toys which are assembled entirely by use of magnets in addition to being breakable upon impact, which may be reassembled. Nor do such earlier designs show toys which also serve as puzzles for children to assemble.

Recently, applicant obtained U.S. Pat. No. 4,886,273 which discloses and claims a toy such as a ball or sphere made up of eight identical wedge-shaped elements. In one embodiment each element is formed from four pieces of preformed plastic, three pieces being flat and the other being arcuate. A magnet is mounted in a predetermined position on each of the flat pieces, and each wedge is assembled by means of an adhesive along the edges of the individual pieces where they adjoined other pieces. Plus and minus signs may be imprinted on the faces of the wedges to reflect the polarity of the magnets beneath the faces. When the ball is assembled, it may be broken apart by an impact, and reassembled. The strength of the materials for the ball and of the magnets, and the placement of the magnets, are chosen such that the impact necessary to break the ball apart will not cause structural damage thereto. In an alternative embodiment described in the '273 patent, the toy is in a cube shape and has eight individual cubes formed in a manner similar to the individual wedge-shaped elements of the ball. In another alternative embodiment described in the '273 patent, the toy is constructed as a pyramid comprised of four individual smaller pyramids, or a baby rattle which is longitudinally divided. Each of the embodiments described in the '273 patent acts as both a reversibly breakable toy and as a child's puzzle. Of course, the toy described in the '273 patent, as well as the toy described herein, may have any desired shape or configuration. Thus, the toy may be shaped to resemble a particular object or it may be given any desired shape such as, for example, an oval, rectangular, octagonal or egg shape.

SUMMARY OF THE INVENTION

The toys, and especially the ball or sphere disclosed in applicant's above-referenced '273 patent is educational, because it requires a certain amount of skill to properly align the magnets and assemble the toy, and entertaining, because when the toy is thrown against a wall, for example, it shatters (or explodes) into its individual elements. Upon the reassembly of the elements, the toy is ready for use again. In fact, it appears that the principal attraction for the toy is its entertainment value, giving both children and adults an opportunity to take the ball and shatter it by throwing it against a wall or the like without causing any harm or damage. Thus, amongst other features of the toy, it provides a harmless, yet often effective way to relieve stress, vent anger, or simply break something without causing harm or destroying anything.

Applicant's above-referenced '273 patent discloses a preferred embodiment for the toy in which the individual elements of a ball, for example, are hollow and formed of a thin, hard plastic having a sufficient wall thickness to prevent the rupture of the elements on normal impact while keeping the plastic thin and light enough so that the magnets can hold the spherical shape of the assembled elements.

Applicant has discovered that the toy, e.g., the ball, is significantly improved if the segments are made of a resiliently deformable, light-weight foam material. In a preferred embodiment of the invention, each segment constitutes a solid body of the foam material, preferably a closed-cell polyurethane foam formed in situ in the mold and having a density in the range of between about 3.5–4.0 lbs. per cubic foot. Such a poor-in-place foam material is available from BJB Enterprises of Garden Grove, California under the trade designation "TC 274 A/B". It is a 2-component flexible polyurethane foam system that was specifically developed for low density molding and which yields a nominal density of the finished product in the range of between about 3.5 to 4.0 lbs. per cubic foot when open blown or not otherwise restricted in its expansion.

A ball assembled of such foam elements has the desired light weight so that it can be thrown, for example, against ordinary windows without breaking them, yet it shatters upon impact. The relatively low density and the resulting low weight of the elements makes it possible to use relatively small and correspondingly inexpensive magnets to hold the elements together until the ball impacts a solid surface.

The foam is extremely resilient, that is, it will return to its original shape irrespective of how much it is compressed or deformed so that the elements will retain their original shape irrespective of how hard the ball is thrown against a surface. Further, the foam has an exceedingly low surface hardness so that it does not scratch, indent, mar or otherwise damage sensitive surfaces such as polished wood panels. In fact, the foam is so soft that even if the ball is thrown at a person and shatters on impact, no harm is possible.

The present invention further applies an outer skin to the foam core so that the former defines exterior surfaces of the elements. The skin has a smooth surface finish and it can be colored, painted or imprinted to give the ball (or other toy) any desired color and appearance. This makes the toy of the present invention aesthetically pleasing, highly attractive and adaptable for various uses. For example, with one type of coloring, imprinting, etc., it may be particularly suited for children while different coloring and/or messages may be used for adults or any other group of potential users.

In the presently preferred embodiment of the invention, the outer skin comprises a thin urethane layer or barrier coat, such as the one available from BJB Enterprises under the trade designation "SC-94". Preferably, the outer skin directly attaches to the foam core of the elements which is achieved by providing a mold for the elements and initially coating the interior surfaces of the mold with the urethane skin material, e.g., by brushing or spraying it onto the mold walls. Thereafter, the constituents of the polyurethane foam are poured into the mold where it foams and expands into direct contact with the surface skin material, thereby bonding the two securely to each other without the need for a separate bonding agent or adhesive.

The mold for the toy elements includes appropriate means for correctly locating and orienting the magnets so that the magnets become embedded in the foam when the foam expands. The magnets can be optionally placed inside the skin material, so that the skin extends over the magnets and thereby effectively hides them from view, or the magnets can be placed on the exterior of the skin material in which event the skin material is sprayed over the surfaces of the magnets facing the interior of the mold, thereby adhering the magnets to the skin and hence to the interior foam.

DETAILED DESCRIPTION OF THE PREFERRED EMBODIMENTS

Figure 1:
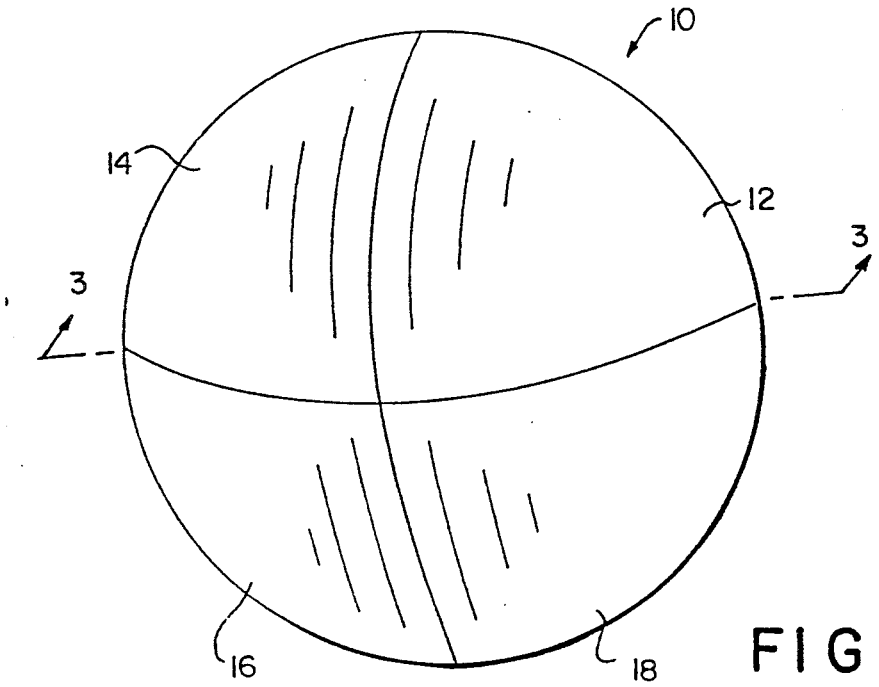
FIG. 1 is a view of the invention in assembled form.
Figure 2:
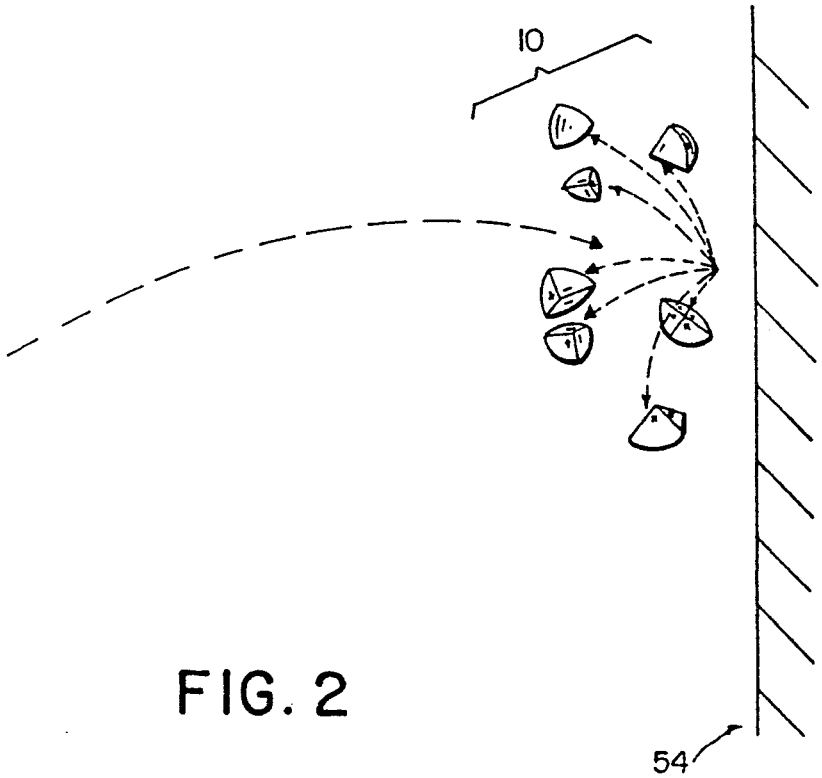
FIG. 2 is an action diagram showing the breakability of the invention.
Figure 4:
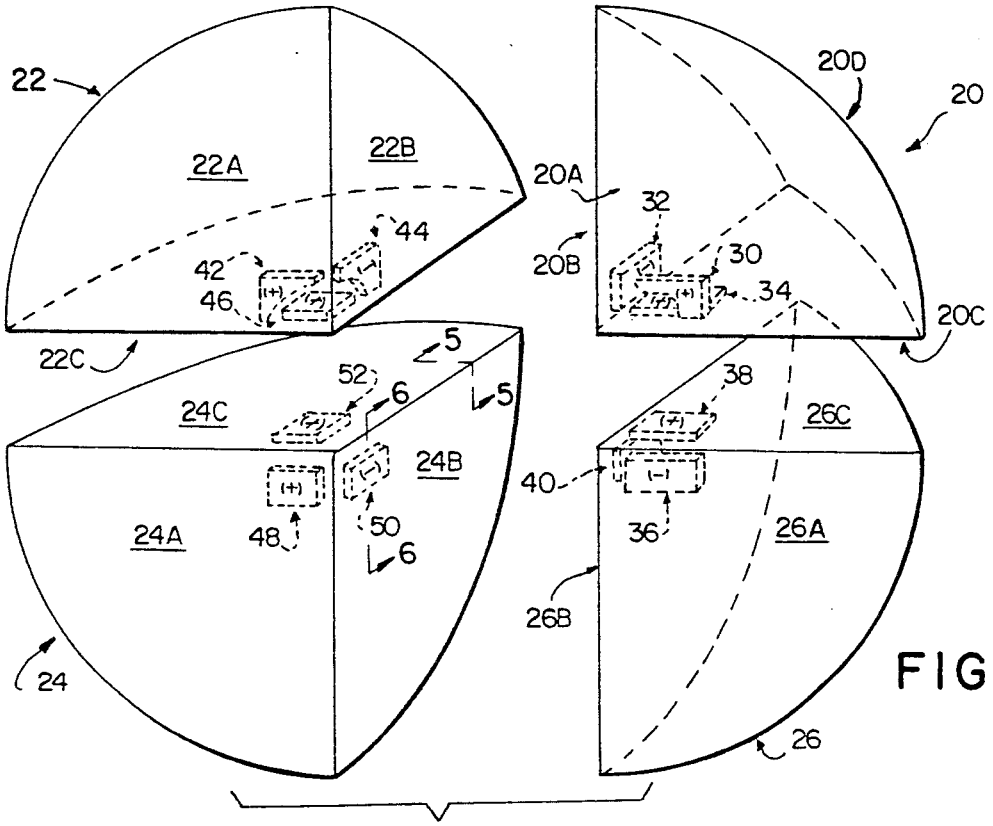
FIG. 4 is an exploded perspective view of FIG. 3.
Figure 5:
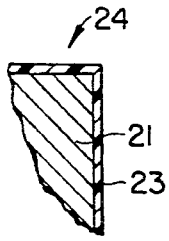
FIG. 5 is an enlarged, fragmentary view, in section, and is taken on line 5—5 of FIG. 4.
Figure 3:
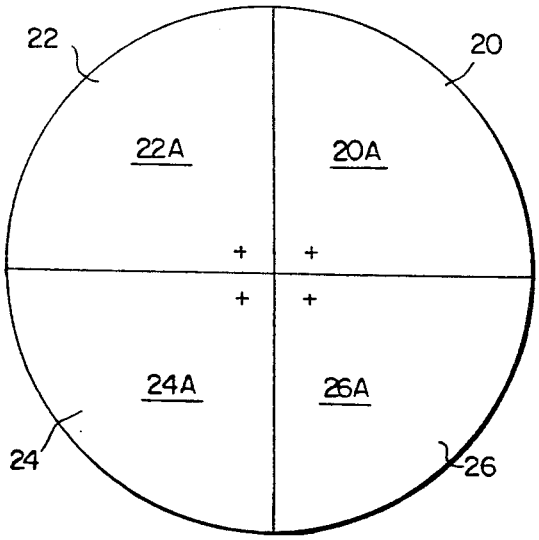
FIG. 3 is a view taken along line 3—3 of FIG. 1.

As shown in FIGS. 1–5, in one embodiment the toy of the present invention is a sphere or ball 10 comprising a plurality of individual elements 12, 14, 16 and 18, and (as illustrated in FIGS. 3 and 4) elements 20, 22, 24 and 26.

As shown most clearly in FIG. 4, each of the individual elements of the ball 10 is preferably identical in shape to each of the other elements, and in this embodiment there are eight such elements (although, if desired, the ball can be divided into fewer or more elements).

The following description relative to element 20 will in general terms apply to each of the other elements. Element 20 is preferably formed from a resiliently deformable, closed cell form, such as the above referred to polyurethane foam, and includes three flat faces 20A, 20B and 20C, and a curved face 20D. Thus, element 20 comprises one-eighth of the ball 10. A magnet, such as magnets 30, 32 and 34, is mounted to each face 20A–20C, respectively.

Element 26 is similar to element 20, and includes a magnet 36 mounted on the interior face 26A, a magnet 38 mounted on the interior of face 26B, and a magnet 40 mounted on the interior of face 268. Similarly, element 22 includes a magnet 42 mounted on the interior of face 22A, a magnet 44 mounted on the interior of face 22B, and a magnet 46 mounted on the interior of face 22C. It will be noted that magnets 30, 42 and 44 are shown in partially cut-away fashion for clarity.

Likewise, element 24 includes a magnet 48 mounted on the interior of face 24A, a magnet 50 mounted on the interior of face 24B, and a magnet 52 mounted on the interior of face 24C.

Each element 20, 22, 24 and 26 is formed of a solid core or body of resilient foam 21. A closed cell, smooth plastic, e.g., urethane outer skin layer 23 is applied to at least the curved face 20D, so that the wall, when all elements are assembled, has a smooth exterior surface, and preferably the skin extends over all surfaces, including flat faces 20A, 20B and 20C (of element 20) so that the skin layer 23 envelopes the foam core 21 entirely.

Preferably, each segment, such as segment 20 is formed in a mold (not shown) having interior walls which conform to the desired size and shape of all exterior surfaces of the element. Initially, the plastic, e.g., the above referred to urethane skin material in its liquid form is sprayed against the mold surfaces and permitted to dry. Thereafter, an appropriate foaming material, e.g., the above referred to polyurethane two-part system, is poured into the mold and permitted to foam and expand into intimate contact with the dried skin material. As a result, the foam core 21 both takes on the shape of the interior mold surfaces, and at the same time, attaches or becomes bonded to the skin layer 23 without the need for a separate bonding agent or adhesive.

Each magnet, such as magnets 30–52, includes a positive pole and a negative pole. These magnets are oriented such that, upon assembly of the ball 10, each magnet will present a pole opposite in sign to the pole of the magnet on the opposing face, i.e. the adjacent face to which it is parallel. Thus, in FIG. 4, faces 20B and 22B are adjacent and parallel, and magnets 32 and 44 are therefore positioned with the negative pole of each magnet to the right in the perspective shown. The positive pole of magnet 32 is therefore presented to the negative pole of magnet 44, with the result that, when faces 20B and 22B are brought relatively near, they will be magnetically fastened together by the magnets 32 and 44. Similarly, the negative pole of magnet 34 on face 20C of element 20 is presented to the positive pole of magnet 38 on face 26C of element 26, such that elements 20 and 26 will be magnetically fastened when faces 20C and 26C are brought together. It will be seen by inspection of the other magnets depicted in FIG. 4 that the polarity of each is configured to allow complete assembly of the hemispherical portion of the ball 10 which is depicted in FIGS. 3 and 4. The elements 12–18 are assembled in a similar fashion, and the two halves of the ball 10 are then fastened to one another. It will be appreciated that element 12 includes a magnet (not separately shown) which presents a negative pole to magnet 30 on face 20A of element 20, and similar magnets mounted on parallel faces of elements 14, 16 and 18 present negative poles to magnets 42, 48 and 36, respectively.

Figure 6:
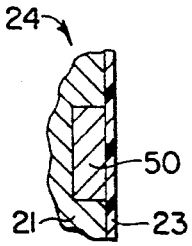
FIG. 6 is an enlarged, fragmentary view, in section, and is taken on line 6—6 of FIG. 4.

As best seen in FIG. 6, the mold (not separately shown) used for forming the smooth skinned, foam bodied elements of the present invention also positions each magnet so that it is appropriately located on the associated face and relative to the other magnets. In one form of the invention, the mold embeds the magnet in foam core 21, that is the mold presents the magnet at the appropriate location and anteriorly of the outer, smooth surface skin 23. Thus, as the raw materials foam and expand inside the mold, foam core 21 completely surrounds and becomes attached to the surfaces of the magnet facing the mold, thereby both correctly locating the magnet with respect to the faces of the element and securing them to the element. After the removal of the element from the mold, the outer skin 23 extends over the magnet and hides it from view.

Alternatively, the magnets are positioned so that they protrude through the smooth surface skin 23, e.g., by positioning the magnets on the interior of the mold before the surface skin material is sprayed onto the mold walls. In this fashion, the skin material will be sprayed over the surfaces of the magnet facing the foam core 21. The magnet will then adhere to the skin layer which, after the core 21 has been foamed, will in turn adhere to the core. An advantage of this construction is that the magnets of opposing element faces can touch each other which enhances their holding power.

In order to assemble the ball 10, each of the elements 12–26 is oriented appropriately relative to the other elements to ensure that each magnet will be presented with a pole of the opposing face opposite to its own outwardly facing pole. For this purpose, positive and negative signs may be imprinted on the faces of the wedge-shaped elements, as depicted in FIGS. 2 and 3, or the elements may be appropriately colored or provided with other suitable codes or markings, to facilitate their assembly. The ball 10 is designed so that a child in play or to relieve frustration may hurl the ball 10 against a wall, such as wall 54 shown in FIG. 2. Upon impact, the ball 10 will explode or break apart into its individual elements, although it is possible that certain elements will remain together (such as the pair of magnetically fastened elements shown in FIG. 2). The breakability of the ball is reversible, since the child may then pick up the individual pieces and reassemble the ball 10, guided by the plus and minus markings on the elements.

An advantage of utilizing a shape such as a sphere is that the individual elements are similar or identical to one another, such that the invention may also as a puzzle for the child. The puzzle may be made more difficult by omitting the plus and minus signs. Thus, presented with eight apparently identical wedges, the child must figure out how to assemble the ball by matching the oppositely polarized magnets carried within.

Each of the magnets 30–52 will have an associated magnetic field which extends around the edges thereof, and thus the magnets should be placed far enough apart so that the magnetic fields do not interfere substantially with magnetic fields of other magnets. For instance, if magnet 46 as shown in FIG. 4 is placed too close to magnet 44, the positive field at the upper right edge of magnet 46 may interact with the positive field from the left side of magnet 32 (when magnets 32 and 44 are fastened together), diminishing the force holding elements 20 and 22 in place. Thus, it is advantageous to separate magnets 46 and 44 by an amount which diminishes this interaction sufficiently to allow magnet 44 and magnet 32 to successfully hold elements 22 and 20 together. The proper placement of the magnets may be empirically determined, such as by ensuring that the magnets are far enough apart that accidentally dropping the ball from a height of, for instance, two feet will not cause the ball to break apart.

A countervailing consideration is that the magnets should be placed as close to the vertex of each element as possible, in order to minimize the force necessary to pull the ball apart. If, for instance, a child wishes to pull the ball apart by hand, he will grasp the ball at its outer surface, and pull one portion of the ball in one direction and another portion in another direction. This exerts a torque upon the magnets equal to the force of the child's pulling times the radius of the ball (presuming the magnets are adjacent the central vertices). If the magnets are nearer to the outer surface of the ball, then the torque required to pry the magnets apart will be greater, since the moment arm is shortened. Thus, the magnets are preferably positioned relatively close to the vertices, but far enough apart to isolate the magnetic fields, as discussed above. Of course, the force necessary to pull the magnets apart without torque considerations (i.e., pulling the wedges directly apart rather than prying them) will be unaffected by the placement of the magnets relative to the vertices.

The placement of the magnets will have a similar effect upon the strength of the impact necessary to break the ball apart. The magnets may be separated upon impact of the ball 10 with the wall 54 by either shearing forces or by differential torque acting on the individual ball elements as the ball begins to break apart. To the extent that torque is exerted on the individual elements, the same principle regarding placement of the magnets as affecting the impact strength necessary to break the ball apart will apply. Thus, it will be understood that the magnets should be placed as close to the vertices of the elements of the ball as possible, while maintaining the structural stability of the ball 10.

The foam core-smooth skinned ball (or other toy) of the present invention is not only safe, harmless and fun to use, it is also exceedingly attractive. The smooth surface and the soft foam material provide an appealing tactile sensation. Moreover, the smooth exterior surface of the ball lends itself to apply all kinds of messages, pictures and/or designs to the ball. Further, the base material for the above-referred to urethane external skin 23 can be colored to provide any desired color. Typically, such urethane material is available in the color white and by adding pigmentation, a wide variety of beige colors can be achieved. The material can also be obtained in clear form so that when it is mixed with pigmentation, the skin will take on the color of the pigments, which makes it possible to achieve virtually any color that may be desired.

Figure 7:
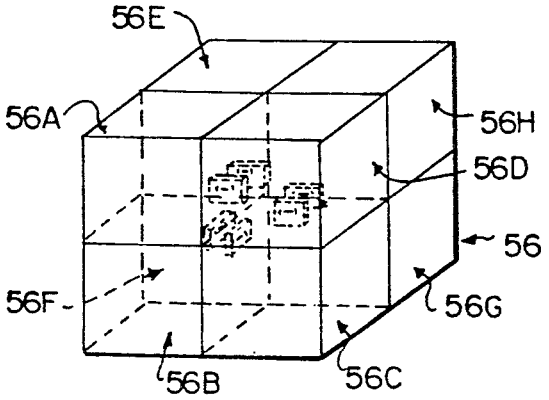
FIG. 7 shows an alternative embodiment of the invention.
Figure 8:
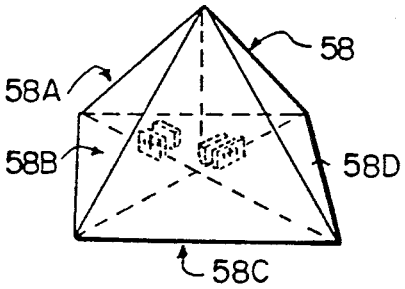
FIG. 8 shows another alternative embodiment of the invention.

Alternative embodiments of the invention are shown in FIGS. 7 and 8, which show a cube 56 and a pyramid 58, respectively. Some of the interior magnets of these embodiments are shown in these figures for purposes of illustration. These embodiments are constructed using the same principles as the embodiments of FIGS. 1–6, and maintain the similarity of the individual elements, so that these embodiments may also be used as puzzles. Thus, cube 56 includes eight identical elements 56A–56H, which include magnets mounted therein, as with the elements 12–26 of the ball 10. Similarly, pyramid 58 includes four identical elements 58A–58D.

Figure 9:
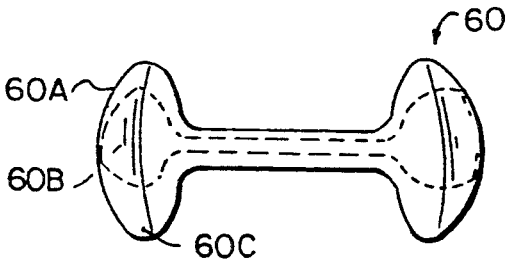
FIG. 9 shows yet another alternative embodiment of the invention.

It will be understood that additional shapes are possible utilizing the principles of the invention. For instance, as shown in FIG. 9, a baby rattle 60 may be used, which is divided into longitudinal sections such as 60A, 60B and 60C. Other configurations, not necessarily including identically shaped elements, are also possible without departing from the spirit and scope of this invention.

What is claimed is:

1. A reversibly breakable toy, comprising:

a plurality of substantially identical wedge-shaped elements, each said element comprising one-eighth of a sphere and having four faces including three flat faces and one arcuate face so that upon assembly of said sphere, each flat face of one element opposes a flat face of another element, each element being formed of a, resiliently deformable foam material, each said element including vertices defined by intersections of the flat faces; and a magnet carried at each flat face, the magnets having positive and negative polarities configured such that, upon assembly, the sphere is held in shape by the magnets, each magnet being mounted at a distance from one of the vertices of a given flat face, the distance being minimized by locating the magnets as close as possible to the vertices without substantially interfering with magnetic fields from magnets mounted on other ones of the faces which are not opposed to the given flat face.

2. The toy of claim 1, wherein the material is a polyurethane foam.

3. The toy of claim 1, including plus and minus signs imprinted on at least one of the faces for indicating positive and negative polarities of the magnets, respectively.

4. A reversibly disassemblable toy comprising:

a plurality of elements, each element comprising a portion of a given geometrical shape and having a plurality of flat faces, the elements being configured so that upon their assembly into the geometrical shape each flat face opposes one other flat face, the elements being constructed of a resiliently deformable foam material, each element including a vertex defined by an intersection of the flat faces; and a magnet carried at each flat face, the magnets having positive and negative polarities configured such that, upon assembly, the geometrical shape is maintained by the magnets, each magnet being mounted at a distance from the vertex of a given flat face, the distance being minimized by locating the magnets as close as possible to the vertex without substantially interfering with magnetic fields from magnets mounted on another face with is not opposed to the given flat face.

5. The toy of claim 4, wherein the geometrical shape is a cube.

6. The toy of claim 4, wherein the geometrical shape is a pyramid.

7. The toy of claim 4, wherein the geometrical shape is a dumbbell shape.

8. The toy of claim 4 including an outer skin applied to at least some of the faces.

9. The toy of claim 8 wherein the outer skin is applied to all faces.

10. The toy material of claim 9 wherein the outer skin includes pigmentation providing the skin with a desired color.

11. A reversibly disassemblable toy comprising:

a plurality of nestable elements which can be assembled into a toy having a desired geometrical shape, each element including at least one nesting surface adapted to be placed against a corresponding nesting surface of another element and at least one exposed face which defines a portion of an exterior surface of the geometrical shape, the element being constructed of a resilient, light-weight foam core and a smooth skin applied to the foam core and defining the surface and the face of the element; and at least one magnet for each nesting surface embedded in the foam material to be flush with the nesting surface, the magnets on the elements being positioned so that pairs of magnets on opposing nesting surfaces are in substantial alignment when the elements are assembled to form the geometrical shape, the opposing magnets being arranged so that they attract each other and thereby releasably secure the elements to each other, the magnets being sized and constructed so that when the toy is thrown against a solid surface, the retention force of the magnets is overcome and the elements separate from each other.

12. The toy of claim 11 wherein the foam core comprises closed cell foam.

13. The toy of claim 12 wherein the foam core comprises polyurethane foam.

14. The toy of claim 11 wherein the outer skin extends over the magnets.

15. The toy of claim 11 wherein a portion of the outer skin is disposed between the magnet and the foam core.

16. The toy of claim 11 wherein the foam core has a density in the range of between about 3.5 to 4.0 lbs. per cubic foot.

17. The toy of claim 11 wherein the outer skin has the shape of the exterior of the element, and wherein the foam core is foamed in situ within the envelope so that the foam adheres directly to the outer skin.

18. The toy of claim 11 including markings applied to the elements to facilitate their assembly into the toy.

19. A toy ball comprising:

a plurality of like shaped elements, each element having at least two angularly inclined flat surfaces defining between them a vertex and an outer face defining a portion of the ball so that the elements can be assembled into the ball by placing corresponding surfaces of the elements against each other, each element being constructed of a resilient, closed cell foam core and having a smooth surface finish at least on its face so that, upon assembly, the ball has a smooth exterior; and a magnet for each flat surface embedded in the foam core so that the magnet is substantially flush with the surface, the magnets on the surfaces being positioned so that there are opposing, substantially aligned magnets in each matching surface pair when the elements are assembled into the ball for retaining the elements in their assembled configuration with the force exerted by the magnets, the magnets being further selected so that their holding force is insufficient to maintain the elements in their assembled form when the ball is thrown against a surface.

20. The toy of claim 19 comprising eight substantially identical elements.

21. The toy of claim 19 wherein the flat surfaces of each element meet at a vertex, and wherein each magnet is mounted at a distance from the adjacent vertex which is minimized by locating the magnet as close as possible to the vertex without substantially interfering with the magnetic field of a magnet mounted on another flat surface of the same element.

22. The toy of claim 19 including markings applied to the elements to facilitate their assembly into the ball.

23. The toy of claim 19 including an outer skin applied to the foam core and defining the smooth surfaces of the elements.

24. The toy of claim 23 wherein the foam core adheres directly to the outer skin material.

25. The toy of claim 19 wherein the outer skin covers the face and the surfaces.

26. The toy of claim 21 wherein the outer skin covers the magnets.

* * * * *